US009022695B2

(12) United States Patent
Chin

(10) Patent No.: US 9,022,695 B2
(45) Date of Patent: May 5, 2015

(54) APPARATUS AND SYSTEM FOR SECURING A HOLLOW PILE IN THE GROUND

(71) Applicant: P3 Infrastructure Consulting Inc., Vancouver (CA)

(72) Inventor: Michael Gregory Chin, Vancouver (CA)

(73) Assignee: P3 Infrastructure Consulting Inc., Vancouver (CA)

( * ) Notice: Subject to any disclaimer, the term of this patent is extended or adjusted under 35 U.S.C. 154(b) by 0 days.

(21) Appl. No.: 13/939,940

(22) Filed: Jul. 11, 2013

(65) Prior Publication Data

US 2014/0112722 A1 Apr. 24, 2014

Related U.S. Application Data

(63) Continuation-in-part of application No. 13/654,430, filed on Oct. 18, 2012, now abandoned.

(51) Int. Cl.

| | |
|---|---|
| ***E02D 7/00*** | (2006.01) |
| ***E02D 5/54*** | (2006.01) |
| ***E02D 7/02*** | (2006.01) |
| ***E02D 7/28*** | (2006.01) |

(52) U.S. Cl.

CPC .. *E02D 5/54* (2013.01); *E02D 7/02* (2013.01); *E02D 7/28* (2013.01)

USPC ..... 405/232

(58) Field of Classification Search

CPC ..... E02D 5/54; E02D 7/28

USPC ..... 405/232, 233, 244–247, 249; 52/155; 166/55, 207, 212

See application file for complete search history.

(56) References Cited

U.S. PATENT DOCUMENTS 2,743,781 A * 5/1956 Lane ..... 166/212
2,884,066 A * 4/1959 Teplitz et al. ..... 166/55

(Continued)

FOREIGN PATENT DOCUMENTS

DE 34 08 862 C2 1/1993
EP 2138638 A1 12/2009

(Continued)

OTHER PUBLICATIONS

International Search Report, dated Nov. 26, 2013, issued from the International Searching Authority for PCT/CA2013/050758.

(Continued)

*Primary Examiner* — Thomas B Will
*Assistant Examiner* — Katherine Chu
(74) *Attorney, Agent, or Firm* — Cameron IP

(57) ABSTRACT

There is provided an apparatus for securing a hollow pile in the ground. The pile has a wall with an inner surface. The apparatus is positionable within the pile. The apparatus includes a housing having an interior and a plurality of apertures. The apparatus includes a plurality of spaced-apart protrusions slidably extending through the apertures of the housing. The protrusions are moveable outwards from the housing for selectively deforming portions of the wall of the pile and creating anchor knobs in the pile upon pressurized hydraulic fluid being applied to the interior of the housing. The apparatus includes a plurality of support members extending outwardly from the housing. The support members are shaped to selectively abut and support the inner surface of the wall of the pile when the anchor knobs are being formed.

16 Claims, 8 Drawing Sheets

(56) References Cited

U.S. PATENT DOCUMENTS

| | | | | | |
|---|---|---|---|---|---|
| 3,471,174 | A | * | 10/1969 | Manning | 285/18 |
| 3,526,069 | A | | 9/1970 | Deike | |
| 3,555,831 | A | * | 1/1971 | Pogonowski | 405/227 |
| 3,628,337 | A | | 12/1971 | Stepanich et al. | |
| 3,676,965 | A | | 7/1972 | Deike | |
| 3,763,655 | A | | 10/1973 | Galuska | |
| 3,797,259 | A | | 3/1974 | Kammerer, Jr. | |
| 3,874,181 | A | * | 4/1975 | Pogonowski | 405/250 |
| 3,995,438 | A | | 12/1976 | Pogonowski | |
| 4,064,703 | A | | 12/1977 | Pogonowski | |
| 4,123,913 | A | * | 11/1978 | Pogonowski | 405/244 |
| 4,160,613 | A | | 7/1979 | Stanwick | |
| 4,479,556 | A | | 10/1984 | Stout et al. | |
| 4,621,396 | A | | 11/1986 | Walker et al. | |
| 4,640,362 | A | | 2/1987 | Schellstede | |
| 4,768,899 | A | * | 9/1988 | Dysarz | 405/195.1 |
| 4,790,384 | A | | 12/1988 | Schellstede et al. | |
| 4,799,829 | A | * | 1/1989 | Kenny | 405/195.1 |
| 4,843,785 | A | | 7/1989 | Sero et al. | |
| 5,494,378 | A | | 2/1996 | Hanson | |
| 5,975,808 | A | | 11/1999 | Fujita | |
| 6,047,505 | A | | 4/2000 | Willow | |
| 6,217,260 | B1 | | 4/2001 | He | |
| 6,793,444 | B2 | | 9/2004 | Kondo et al. | |
| 7,695,218 | B2 | | 4/2010 | Maione | |
| 7,736,095 | B2 | | 6/2010 | Fujita | |
| 2008/0031694 | A1 | | 2/2008 | Wissmann et al. | |
| 2011/0247815 | A1 | * | 10/2011 | Jelsma | 166/298 |

FOREIGN PATENT DOCUMENTS

| | | | |
|---|---|---|---|
| GB | 1532223 | | 11/1978 |
| GB | 1034128 | | 6/1996 |
| GS | 2181174 | A | 4/1987 |
| JP | 2009078604 | | 3/1997 |
| JP | 2004218215 | | 8/2004 |
| JP | 2008169564 | | 7/2008 |

OTHER PUBLICATIONS

English translation of Japanese Patent Reference No. JP2004218215.
English translation of Japanese Patent Reference No. JP2008169564.
English translation of Japanese Patent Reference No. JP2009078604.
English abstract of DE 3408862 (A1).
English abstract of EP2138638 (A1).
International Search Report, dated Jul. 17, 2014, issued from the International Searching Authority for PCT/CA2014/050392.

* cited by examiner

APPARATUS AND SYSTEM FOR SECURING A HOLLOW PILE IN THE GROUND

CROSS REFERENCE TO RELATED APPLICATION

This application is a continuation-in-part application of U.S. patent application Ser. No. 13/654,430 filed in the United States Patent and Trademark Office on Oct. 18, 2012, the disclosure of which is incorporated herein by reference and priority to which is claimed.

FIELD OF THE INVENTION

There is provided an apparatus and system for a hollow pile. In particular, there is provided an apparatus and system for securing a hollow pile in the ground.

DESCRIPTION OF THE RELATED ART

United Kingdom Patent No. 1,034,128 to Serota provides a method of securing a pile in the ground. The method includes the step of inserting a tubular casing into the ground and thereafter expanding the casing by means of an expanding mechanism. The expanding mechanism may comprise a plurality of rams radially disposed therearound which are adapted to expand for deforming the casing material.

U.S. Pat. No. 3,995,438 to Pogonowski discloses a plurality of pistons and cylinders suspended from a swage block. The pistons and cylinders are actuatable radially from the longitudinal axis of a tubular member for making a new pile with anchor knobs for increased load carrying capacity and pull-out resistance.

In the above systems, the pile walls may deform inwards at regions of the pile where the rams/pistons are not pushing outward. This in turn may compromise the integrity of the pile. This inward deformation may also reduce the integrity of the outer pile wall-to-soil contact area and interface, thereby reducing the shaft resistive friction force of the pile.

FIG. 3 of U.S. Pat. No. 4,064,703 to Pogonowski provides a cylindrical housing that holds a multiplicity of barrels. The barrels are in a horizontal plane and fire radially outwards. Rows of bumps in the pile are thereby formed.

The above system may require the outer diameter of the cylindrical housing to be substantially equal to the inner diameter of the pile in order to avoid the above mentioned inward deformations of the pile. Such a system thus may be relatively restrictive in its applications. It may also suffer from the above integrity issues should it be used in piles that are, for example, ¼ inch or larger in diameter compared to the diameter of the cylindrical housing. This is because even a very small amount of inward movement of the pile wall may significantly reduce the integrity of the outer pipe wall-to-soil contact area and interface.

There is accordingly a need for an apparatus for securing a pile in the ground in a manner that maintains the integrity of the pile and its pile wall-to-soil contact surface, while also having the versatility to accommodate variations in the size and types of piles.

BRIEF SUMMARY OF INVENTION

There is provided a system and apparatus for securing a hollow pile in the ground disclosed herein that overcomes the above disadvantages.

There is accordingly provided an apparatus for securing a hollow pile in the ground. The pile has a wall with an inner surface. The apparatus is positionable within the pile. The apparatus includes a housing having an interior and a plurality of apertures. The apparatus includes a plurality of spaced-apart protrusions slidably extending through the apertures of the housing. The protrusions are moveable outwards from the housing for selectively deforming portions of the wall of the pile and creating anchor knobs in the pile upon pressurized hydraulic fluid being applied to the interior of the housing. The apparatus includes a plurality of support members extending outwardly from the housing. The support members are shaped to selectively abut and support the inner surface of the wall of the pile when the anchor knobs are being formed.

There is also provided an apparatus for securing a hollow pile in the ground. The pile has a wall with an inner surface. The apparatus includes a housing having an aperture and an interior. The housing is positionable within the pile. The apparatus includes a protrusion slidably connected to the housing through the aperture. The protrusion has a proximal end in communication with the interior of the housing and a distal end which is spaced-apart from the proximal end. The protrusion moves outwards towards the inner surface of the pile to create an anchor knob in the pile via its distal end upon pressurized hydraulic fluid being applied to the interior of the housing. The apparatus includes a support member extending outwardly from the housing. The support member is shaped to selectively abut and support the inner surface of the wall of the pile when the anchor knob is being formed.

There is further provided a method of securing a hollow pile to the ground using an anchor-knob forming apparatus. The pile has a wall with an inner surface. The apparatus includes a plurality of spaced-apart protrusions and a plurality of circumferentially spaced-apart support members. The method includes the step of driving the pile into the ground. The method includes the step of lowering the apparatus into a portion of the pile driven into the ground. The method includes the step of moving the support members outwards by supplying pressurized hydraulic fluid to the apparatus. The method includes the step of moving the protrusions outwards and against the wall of the pile by supplying pressurized hydraulic fluid to the apparatus and thereby forming anchor knobs in the pile.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
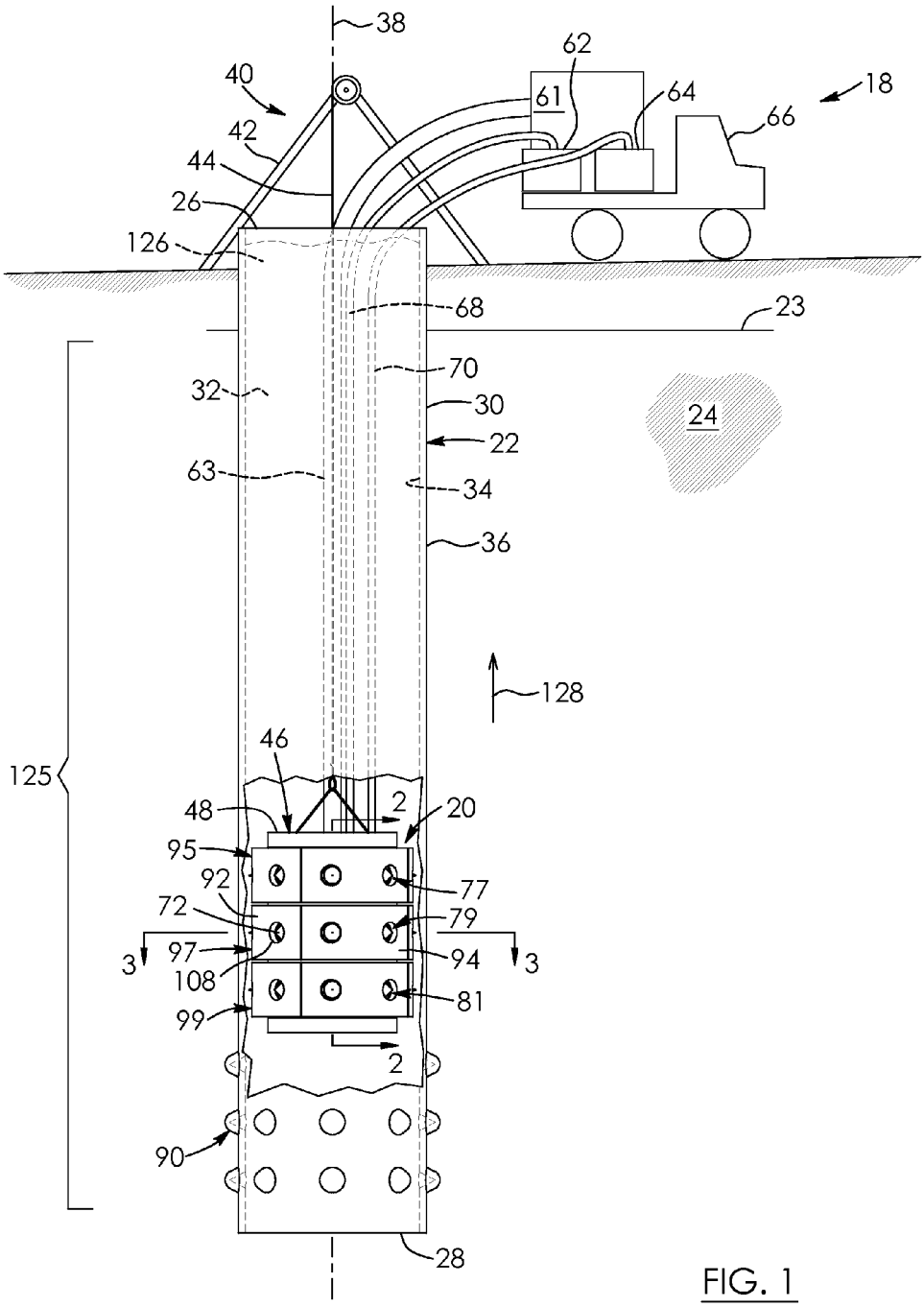
FIG. 1 is a front elevation, partially broken away view of a system for securing a hollow pile into the ground, the system including an apparatus therefor positioned within the pile, the pile being shown in fragment in part to reveal the apparatus.

Referring to the drawings and first to FIG. 1, there is shown a system 18 for securing a hollow pile, in this example tubular pile 22, in the ground 24. There is also typically groundwater within the ground, as shown by the groundwater table 23 in FIG. 1. In other embodiments, the pile may be rectangular, square or other shapes in cross-section. The pile has an open top end 26, a bottom end 28 spaced-apart from the top end, a side wall 30 that is annular in this example, and an interior 32. In this example, the bottom end 28 is closed, but in other embodiments the bottom end may be open. In this case, the pile 22 may be pile driven into the ground, with interior 32 of the pile then being cleaned out. The packed-in ground at the bottom end of the pile would function to at least partially seal the interior 32 of the pile thereby.

The wall extends from end 26 to end 28. The wall 30 has an inner surface 34 in communication with the interior 32 of the pile 22 and an outer surface 36 facing outwards away from the pile. The pile 22 has a longitudinal axis 38 that extends through ends 26 and 28. The pile is shown in FIG. 1 already driven into the ground 24 via a pile driver (not shown). The driving of piles into the ground per se is well known to those skilled in the art and therefore will not be described in more detail.

The system 18 includes a lifting and lower assembly, in this example in the form of a winch mechanism 40 and a winch mount 42. The winch mechanism is supported by the winch mount, which in this example is an angled, frame structure positionable above open top end 26 of the pile 22. The winch mechanism 40 selectively lowers and raises a cable 44 that extends into the interior 32 of the pile 22. Winch mechanisms per se, including their parts, support structures and various functionings, are well known to those skilled in the art and therefore mechanism 40 will not be described in further detail.

The system 18 includes an apparatus 20 for securing pile 22 in the ground 24. The apparatus is operatively connected to cable 44 and is positionable within the interior 32 of the pile 22 via the winch mechanism 40, as seen in FIG. 1.

Figure 2:
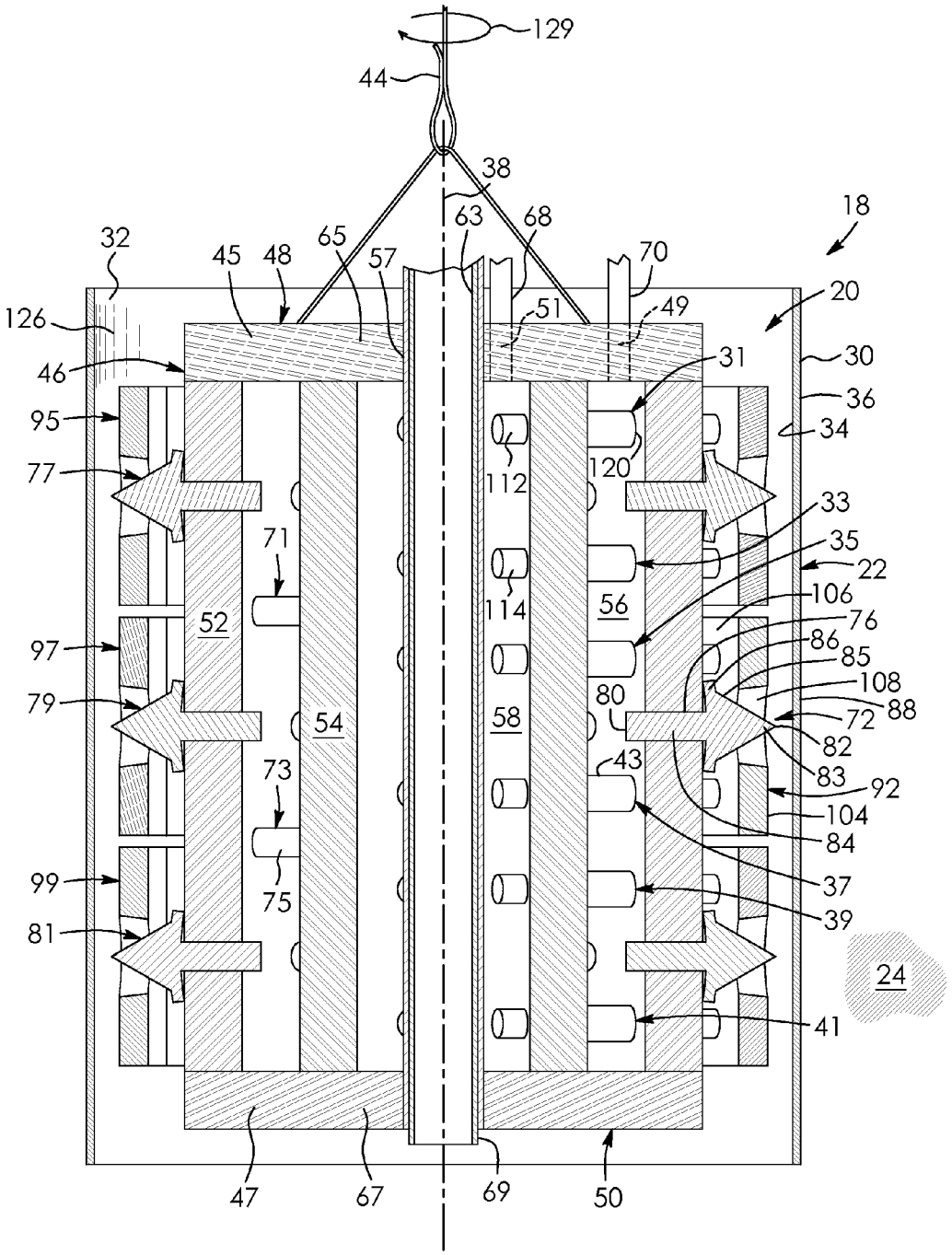
FIG. 2 is an elevation sectional view of the pile and apparatus taken along lines 2-2 in FIG. 1, the apparatus being shown in a retracted mode.
Figure 3:
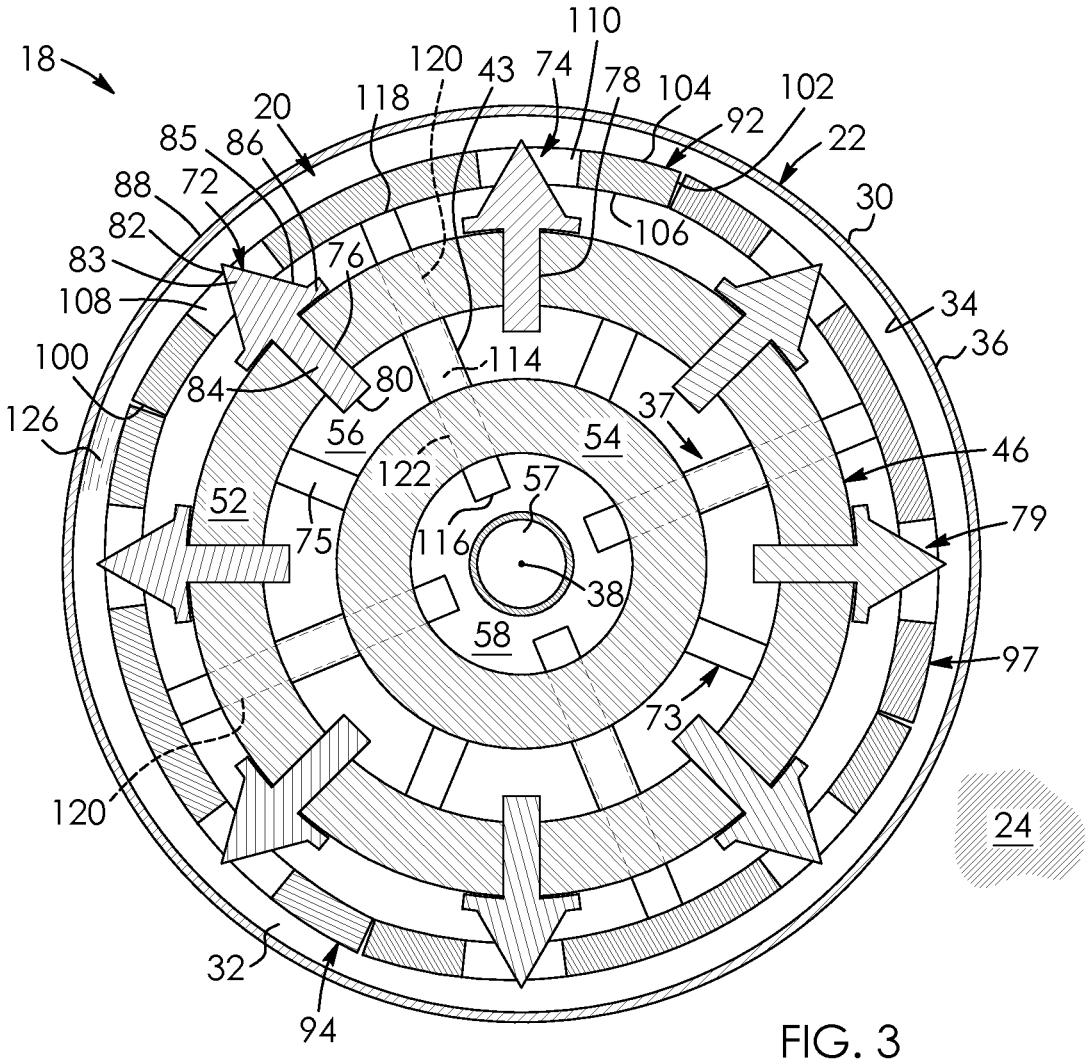
FIG. 3 is a cross-section sectional view of the pile and apparatus taken along lines 3-3 in FIG. 1, the apparatus being shown in the retracted mode and including a plurality of circumferentially spaced-apart protrusions and support members.

As best seen in FIGS. 2 and 3, the apparatus 20 includes a housing 46 that is substantially cylindrical in this example with a hollow interior. As seen in FIG. 2, the housing includes a closed top 48 and a closed bottom 50 spaced-apart from the top. The top and bottom of the housing 46 are circular in this example. Cable 44 seen in FIG. 1 is connectable to top 48 of the housing in this example. As seen in FIG. 2, top 48 of the housing has a pair of radially spaced-apart apertures 49 and 51 extending therethrough.

As best seen in FIG. 3, the housing 46 includes an outer wall 52 that is annular in this example, and an inner wall 54 that is also annular in this example. The outer and inner walls extend between and are connected together via the top 48 and bottom 50 of the housing, as shown in FIG. 2. The inner wall 54 of the housing 46 is thus operatively connected to and is radially-inwardly spaced-apart from the outer wall 52.

Referring to FIGS. 2 and 3, the apparatus 20 includes a plurality of axially spaced-apart, circumferentially arranged sets 31, 33, 35, 37, 39 and 41 of circumferentially spaced-apart sleeves, as shown by sleeve 43 seen FIG. 3. The sleeves extend between and connect the outer wall 52 and inner wall 54 together. The sets 31, 33, 35, 37, 39 and 41 of sleeves are axially spaced-apart. In this example, there are six sets and each set 37 of sleeves comprises four circumferentially spaced-apart sleeves 43 as seen in FIG. 3.

As seen in FIG. 2, the apparatus 20 includes a plurality of axially spaced-apart, circumferentially arranged sets 71 and 73 of circumferentially spaced-apart braces, as shown by brace 75. The braces extend between and connect the outer wall 52 and inner wall 54 together. In this example, there are two sets 71 and 73 which are axially spaced-apart. As seen in FIG. 3, each set 73 of braces 75 in this example comprises four circumferentially spaced-apart braces interposed between the sleeves 43. Other numbers of sleeves and braces are possible in other embodiments.

The housing 46 includes a central passageway 57 that extends from top 48 to bottom 50 of the housing. The passageway is tubular in this example and is positioned to be coaxially with the pile 22 and is aligned with the longitudinal axis 38 of the pile. Referring back to FIG. 1, the system 18 includes a truck 66 in this example and a pile fill material mixer, in this example a concrete mixer 61 having a pile fill material, in this example concrete therein. In other embodiments, the fill material can be sand, or control density fill, for example. The mixer is mounted on the truck in this example. A conduit 63 selectively connects to the mixer 61 and extends through the passageway 57, as seen in FIG. 2, with the distal end 69 of the conduit aligning adjacent to the bottom 50 of the housing 46 in this example. The passageway 57 is shaped to receive the wet concrete therethrough for filing the pile with the concrete at those portions below the apparatus 20 upon raising the housing to a different longitudinal section along the pile 22.

As seen in FIG. 2, the housing 46 includes in this example an outer chamber 56 interposed between the inner wall 54 and the outer wall 52 of the housing. The outer chamber is also interposed between outer, annular portion 45 of the top 48 and outer, annular portion 47 of the bottom 50 of the housing. The sleeves 43 extend through the outer chamber 56. As seen in FIG. 2, chamber 56 is in fluid communication with aperture 49.

The housing 46 includes an inner chamber 58 positioned between the inner wall 54 of the housing and passageway 57. As seen in FIG. 2, the inner chamber is also interposed between annular, inner portion 65 of the top 48 and annular, inner portion 67 of the bottom 50 of the housing. Portions 45 and 47 of the top and bottom of the housing are radially spaced-apart from portions 65 and 67 of the top and bottom of the housing. The outer chamber 56 and the inner chamber 58 are both annular in this example. Aperture 51 of top 48 is in fluid communication with chamber 58.

As best seen in FIG. 1, the system 18 includes a first pressurized hydraulic fluid source, in this example a reservoir 62 from which hydraulic fluid is pumped under a first pressure. The system includes a second pressurized hydraulic fluid source, in this example a reservoir 64 from which hydraulic fluid is pumped under a second pressure. The reservoirs are mounted on the truck 66 in this example. A pair of conduits 68 and 70 are hydraulically connected to reservoirs 62 and 64, respectively. As seen in FIG. 2, conduit 68 connects to top 48 of housing 46 via aperture 51. Reservoir 62 is thus in fluid communication with inner chamber 58. Conduit 70 connects to the top of the housing in this example via aperture 49 and thus reservoir 64 is in fluid communication with outer chamber 56.

Referring to FIG. 3, the apparatus 20 includes a plurality of spaced-apart protrusions, as shown by protrusions 72 and 74. The protrusions radially extend outwards in this example and are circumferentially spaced-apart. There are three axially spaced-apart, circumferentially-arranged sets 77, 79 and 81 of protrusions in this example, as seen in FIG. 2. Each set in this example comprises eight circumferentially spaced-apart protrusions in this example, as seen by protrusions 72 and 74 for set 79 in FIG. 3. The protrusions 72 and 74 slidably extend through corresponding axially spaced-apart and circumferentially spaced-apart apertures of the housing 46 in this example, as shown by apertures 76 and 78 in FIG. 3 for protrusions 72 and 74.

Each protrusion has a proximal end in communication with chamber 56 and a distal end which is radially spaced-apart from the proximal end, as seen by proximal end 80 and distal end 82 for protrusion 72. The protrusions are thus in fluid communication with the outer chamber 56. The distal ends 82 of the protrusions are conical in this example, though this is not strictly required. For example, the distal ends may have pyramid-like shapes or be dome-shaped in other embodiments. The distal ends of the protrusions 72 are outwardly tapered with outer pointed portions 83 and base portions 85 which are spaced-apart from and larger than the pointed portions. In this example, the base portions extend radially outwards relative to the pointed portions. Each protrusion 72 includes a piston member, in this example an elongate shaft 84 that extends from its proximal end 80 towards its distal end 82. The elongate shafts slidably and sealably extend through apertures 76 of outer wall 52.

Each protrusion 72 includes a stopping member 86 that is arcuate-shaped and circumferentially extending in this example. Each stopping member is connected to and is interposed between a respective base portion 85 of the distal end 82 of the respective protrusion 72 and shaft 84. The stopping members extend radially outwards relative to the base portions 85 of the distal ends 82 of the protrusions 72 in this example.

Figure 5:
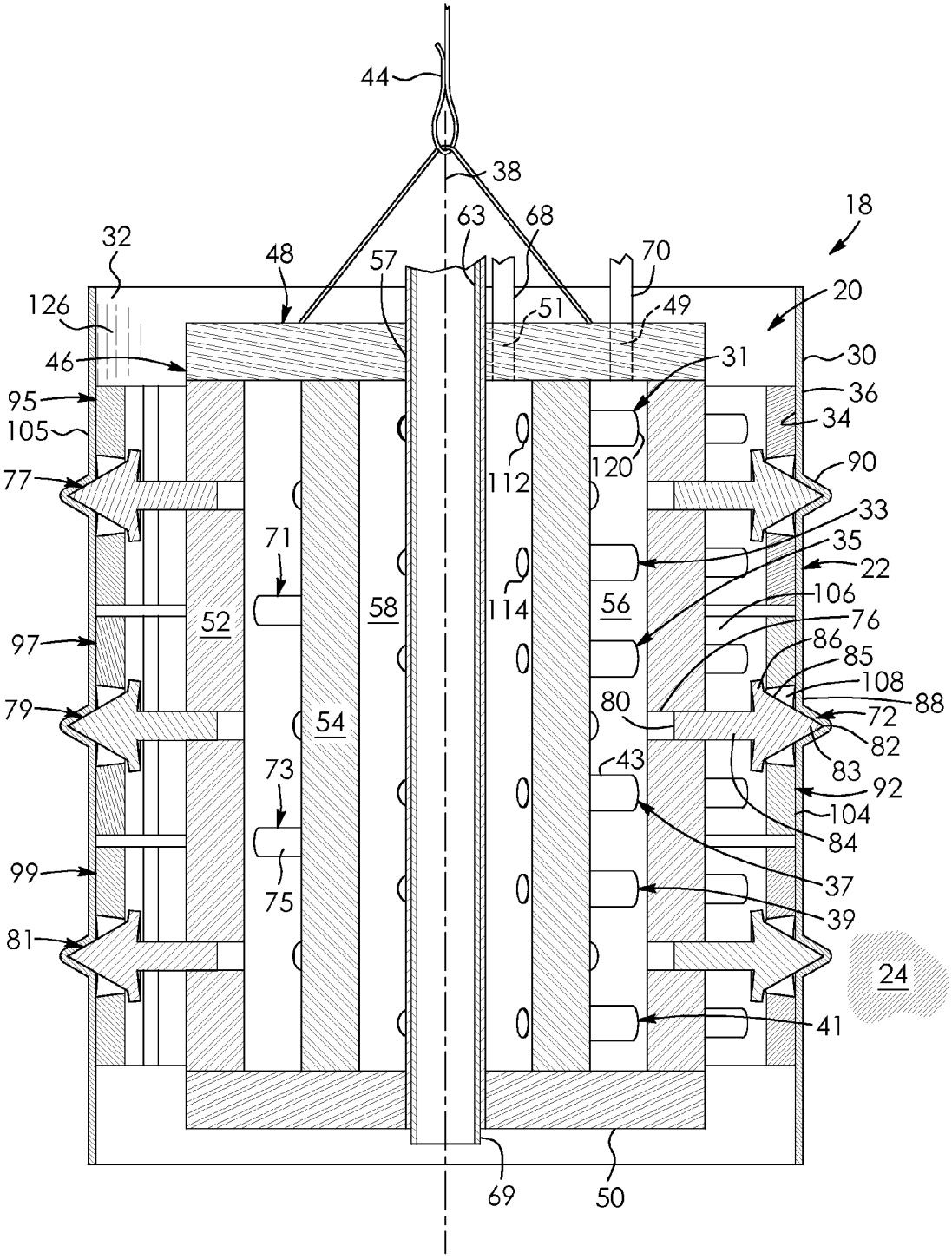
FIG. 5 is an elevation sectional view similar to FIG. 2 of the pile and apparatus of FIG. 1, the apparatus being shown in an actuated mode and forming knobs in the pile.

The protrusions 72 and 74 are moveable outwards from the housing 46 towards the inner surface 34 of the wall 30 of the pile 22. They move outwards and selectively deform portions 88 of the wall 30 of the pile 22 upon pressurized hydraulic fluid from reservoir 64, seen in FIG. 1, being applied to the outer chamber 56 of the housing 46. The protrusions via their distal ends 82 create anchor knobs 90 in the pile thereby as seen in FIG. 5.

The apparatus 20 includes a plurality of support members, as shown by support members 92 and 94 in FIG. 3. In this example there are three axially spaced-apart, circumferentially arranged sets 95, 97 and 99 of support members, as seen in FIG. 2. The sets 77, 79 and 81 of the protrusions 72 and 74 correspond to the sets 95, 97 and 99 of the support members, respectively. In this example, each set of support members comprises four circumferentially spaced-apart support members, as shown by support members 92 and 94 for set 97 seen in FIG. 3. Each support member is arcuate-shaped in this example. The support members are located radially outwards from the housing 46.

Figure 4:
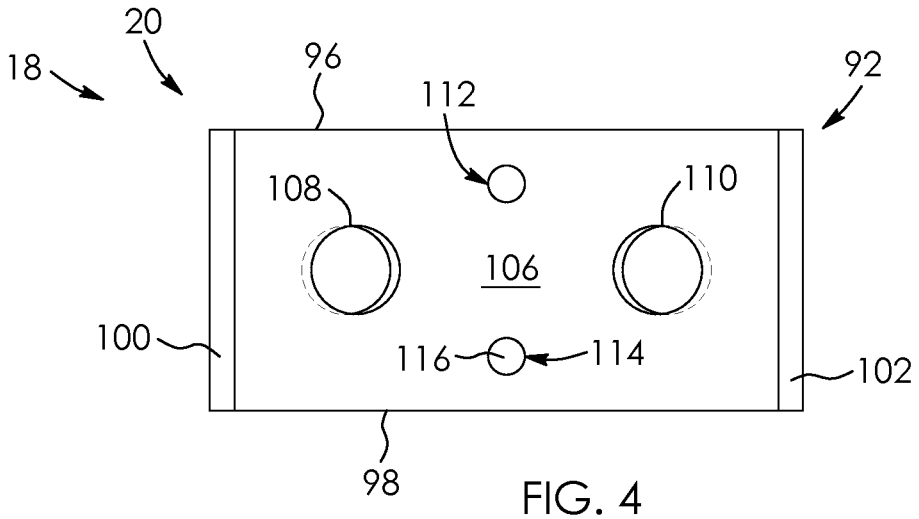
FIG. 4 is an inside, front perspective view of one of the support members of FIG. 3.

As seen in FIG. 4, each support member 92 has a top 96, a bottom 98 opposite the top, and a pair of spaced-apart sides 100 and 102 that extend between the top and bottom thereof. The tops 96 and bottoms 98 are arcuate-shaped in this example as seen in FIG. 3 and extend parallel to axis 38. Each support member has a convexly-shaped, or arcuate-shaped, outer surface 104 facing the inner surface 34 of the pile 22 and a concavely-shaped inner surface 106 in this example facing the outer wall 52. The surfaces 104 and 106 are generally rectangular in this example and extend between the sides 100 and 102 and top 96 and bottom 98 of the support member 92.

Each support member has at least one aperture, and in this example has a pair of circumferentially spaced-apart apertures 108 and 110, as seen in FIG. 4, that extend from surface 104 to surface 106. The apertures are positioned between the top and bottom of each support member 92 in this example. Aperture 108 is positioned adjacent to side 100 and aperture 110 is positioned adjacent to side 102 in this example. As seen in FIG. 3, the distal ends 82 of the protrusions 72 and 74 extend through the apertures 108 and 110 of the support members. The stopping members 86 are larger than the apertures 108 and 110 of the support members 92.

The apparatus 20 includes a plurality of piston members, in this example actuator rods, in this example a pair of actuator rods 112 and 114 per support member 92 as seen in FIG. 4. The actuator rods are interposed between sides 100 and 102 in this example and are interposed between apertures 108 and 110 in this example. Actuator rod 112 is positioned adjacent to top 96 of the support member 92 and actuator rod 114 is positioned adjacent to bottom 98 of the support member in this example. Each actuator rod has a proximal end 116 and a distal end 118, seen in FIG. 3, which is spaced-apart from its proximal end. The distal ends of the actuator rods connect to the inner surfaces of the support members, as seen in FIG. 3 by distal end 118 of actuator rod 114 connecting to surface 106 of the support member 92.

The proximal ends 116 of the actuator rods 114 are in fluid communication with the inner chamber 58. Each actuator rod sealably and slidably extends through one of circumferentially and axially spaced-apart apertures 120 of the outer wall 52, seen in FIG. 3, through one of sleeves 43, seen in FIG. 3, and through one of circumferentially and axially spaced-apart apertures 122 of the inner wall 54. Apertures 120 and 122 are circumferentially spaced-apart from apertures 76 and 78 of outer wall 52. The support members 92 thus extend outwardly from the housing 46 and the support members 92 and 94 slidably connect to the housing 46 via the actuator rods 112 and 114.

The support members 92 and 94 have a retracted position, seen in FIGS. 2 and 3, in which the support members are radially inwardly spaced-apart from the inner surface 34 of the wall 30 of the pile 22. Adjacent ones of the support members abut each other in the retracted position at their sides 100 and 102 as seen in FIG. 3. Pressurized hydraulic fluid from reservoir 62 seen in FIG. 1, which is applied to the inner chamber 58 seen in FIG. 2, causes the support members to move radially outwards to an extended portion, seen in FIGS. 5 and 6, for abutting the inner surface 34 of the wall 30 of the pile 22. The support members are proximal to each other so as to substantially support those portions 105 of the inner surface of the wall of the pile which extend circumferentially around the protrusions when the anchor knobs 90 are being formed.

Figure 6:
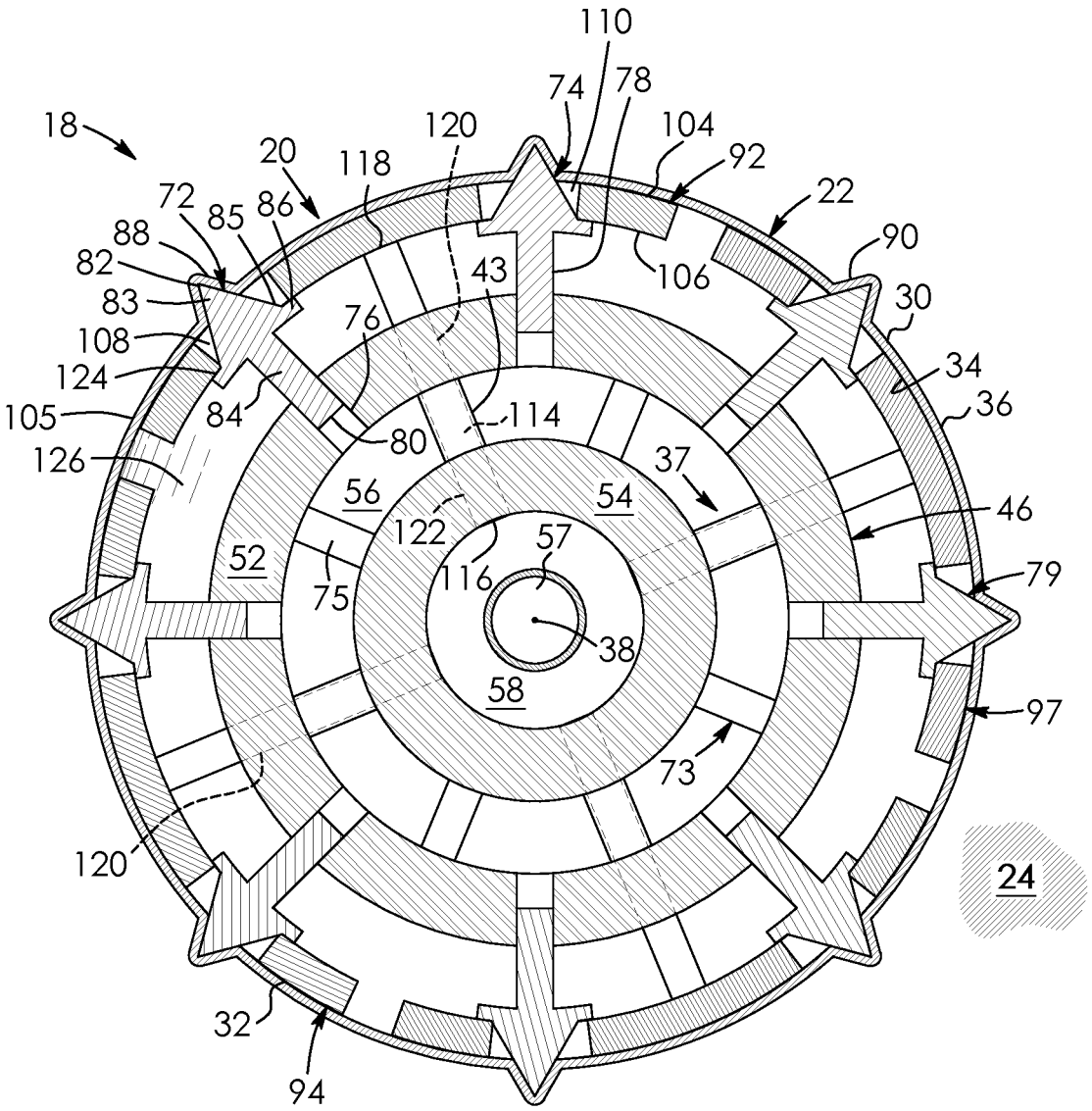
FIG. 6 is a cross-sectional sectional view similar to FIG. 3 of the pile and apparatus of FIG. 1, the apparatus being shown in the actuated mode and forming knobs in the pile.

Pressurized hydraulic fluid from reservoir 64, seen in FIG. 1, is next applied to cause the protrusions 72 and 74 to move outwards with their distal ends 82 moving radially past the support members 92 to form anchor knobs 90 in the pile as seen in FIGS. 5 and 6. In this example, the distal ends 82 move radially through apertures 108 and 110 of the support members 92 and 94. In other embodiments, the protrusions may be moved between adjacent ones of the support members such as, for example, between their sides 100 and 102 and/or between tops 96 and bottoms 98 of adjacent ones of the support members.

As seen in FIG. 6, the stopping members 86 abut portions 124 of the inner surface 106 of the support members 92 adjacent to the apertures 108 of the support members upon the anchor knobs 90 being formed. The stopping members are shaped to abut the support members upon the anchor knobs being formed and are shaped to inhibit radially outwards movement of the protrusions thereafter. The stopping members 86 thus inhibit piercing of the pile wall, as could otherwise occur as seen by pierced anchor knob 101 in FIG. 9.

Should the knobs be pierced, this can reduce the skin friction between the outer surface 36 of the pile and the surrounding soil because groundwater can seep into the pile, causing soil migration and disrupting this soil-to-pile contact.

Figure 7:
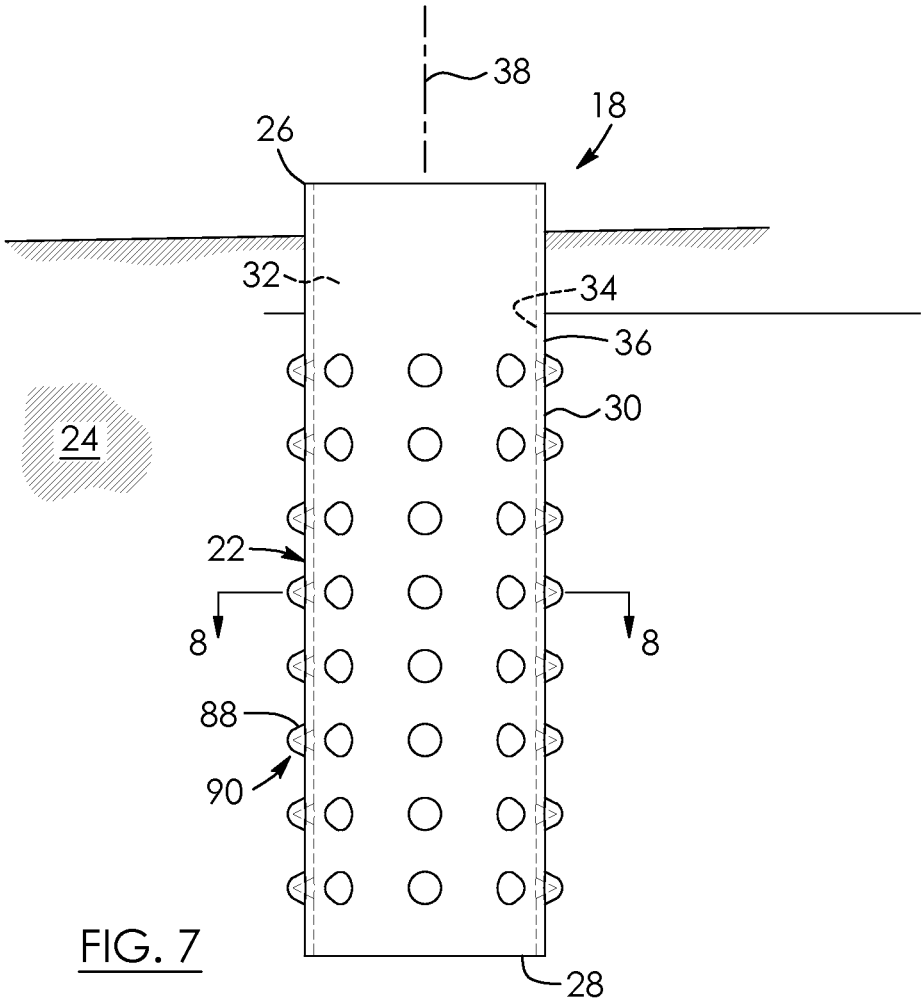
FIG. 7 an elevation view of the pile of FIG. 1, the pile having a plurality of radially and axially spaced-apart knobs extending along its length.
Figure 8:
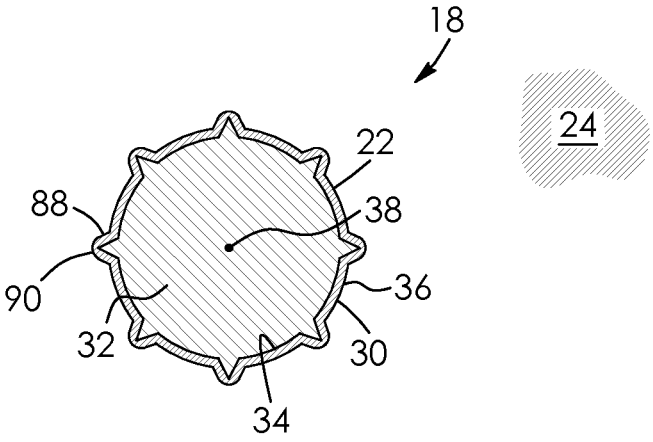
FIG. 8 is a cross-sectional sectional view taken along lines 8-8 of FIG. 7 showing the pile of FIG. 7 filled with a pile fill material, in this example concrete.

In this manner, knobs 90 may be selectively formed in the pile 22, as seen in FIG. 1. The protrusions and support members may then be selectively retracted, moving inwards towards the housing 46. The apparatus 20 may then be selectively raised by winch mechanism 40 via cable 44 to form knobs along other sections axially spaced-apart along the length of the pile, as seen in FIGS. 7 and 8. Alternatively, the apparatus 20 may be axially rotated, by for example rotating cable 44, with the apparatus 20 then being in position to form further knobs that are circumferentially spaced-apart from the knobs 90.

The pile with the knobs so formed may be better secured to the ground compared to a pile having no such anchor knobs. The invention as herein described may be particularly useful for situations where the pile 22 relies on pure shaft resistance and little to no toe resistance but is useful for any tubular pile. Toe resistance may refer to the resistance of the pile arising from the bottom end of the pile standing on hard soil.

According to another aspect, there is a method for securing the pile 22 in the ground 24. The method includes first driving the pile into the ground according to a convention manner, using a pile driver, for example. The method includes lowering the apparatus 20 into the portion 125 of the pile driven into the ground 24, as seen in FIG. 1. The method next includes filing the pile with water 126 seen in FIG. 1 in this example so that the water within the pile is above the groundwater table 23 seen in FIG. 1. Adding water to the pile in this manner may ensure that the water pressure within the pile is equal to and greater than that of the surrounding groundwater. The water so positioned within the pile thus inhibits soil from entering into the pile should the anchor knobs pierce through the pile, and thus inhibits soil migration associated with ground water and promotes the integrity of the skin friction and the shaft resistance of the pile.

Referring to FIG. 1, the method includes lowering the apparatus 20 into a desired place within the interior 32 of the pile 22 by actuating cable 44 of winch mechanism 40 in this example.

The method next includes moving the support members 92 and 94 radially outwards by supplying pressurized hydraulic fluid from reservoir 62 seen in FIG. 1 to chamber 58 of the apparatus 20 as seen with reference to FIGS. 3 and 6. The method next includes moving the protrusions 72 and 74 radially outwards and against the wall 30 of the pile 22 by supplying pressurized hydraulic fluid from reservoir 64 seen in FIG. 1 to chamber 56 of the apparatus 20 as seen with reference to FIGS. 3 and 6 and forming anchor knobs 90 in the pile thereby.

The protrusions and support members are then hydraulically retracted radially inwards such that the support members remain spaced-apart from and free of the inner surface 34 of wall 30 of the pile 22 as seen in FIG. 2.

Figure 9:
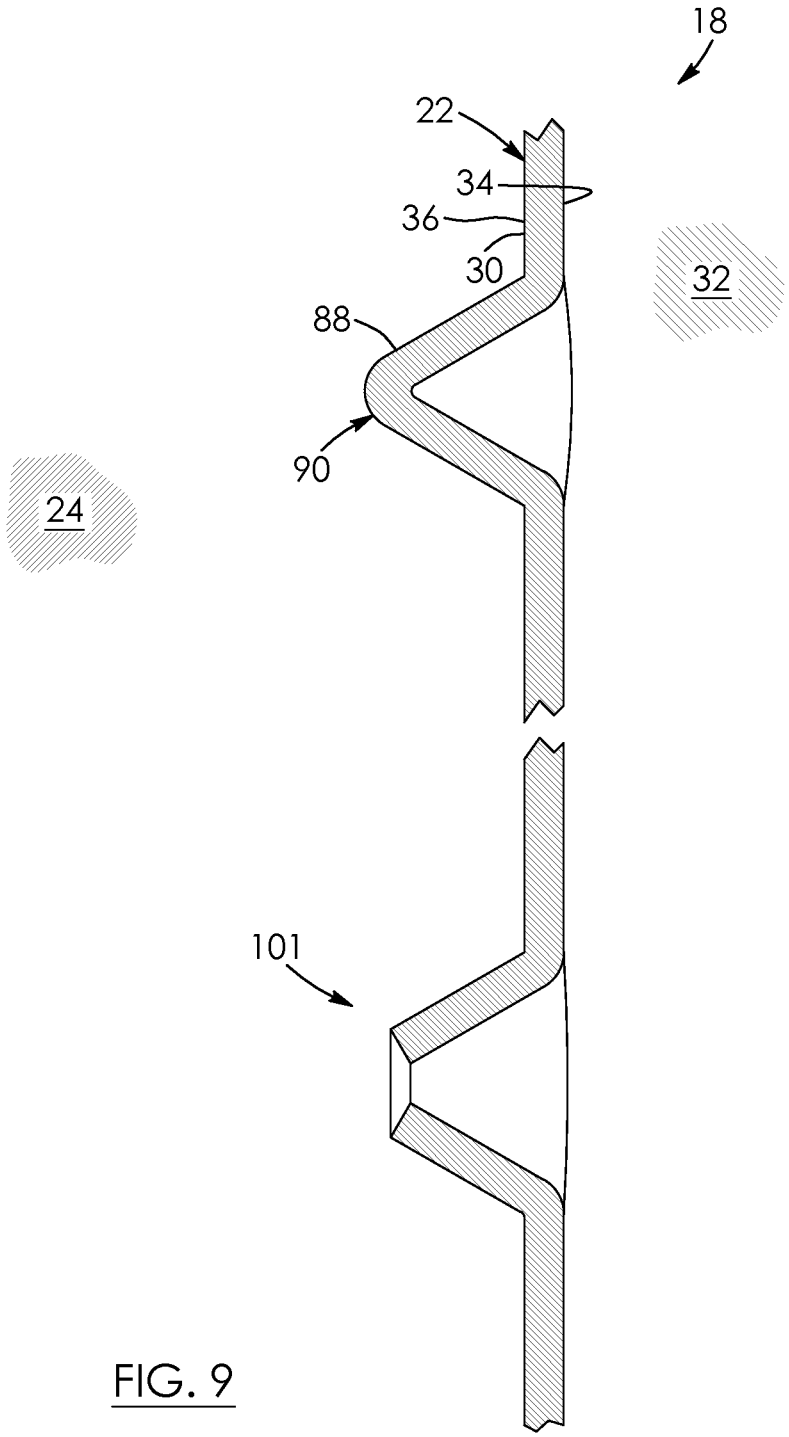
FIG. 9 is an enlarged view of the pile of FIG. 7 shown in fragment, showing some of the knobs of the pile in greater detail.

The apparatus 20 may then be selectively raised upwards, as shown by arrow 128 in FIG. 1, and/or rotated as shown by arrow 129 in FIG. 2, while wet concrete simultaneously is poured through passageway 57. The concrete may increase the internal shear capacity of the inner pile wall to pile fill material. It may also act to inhibit the effects of puncturing of the pile, as seen in FIG. 9, by quickly filling in such gaps with concrete and reducing the effects or extent of an soil migration. The concrete may also be compacted down, thereby forcing the material out of the pierced portions of the anchor knobs to this end. Voids in the concrete may also be reduced and the shear strength of the pile thus increased thereby. Further knobs may next be formed in the manner described above and the process repeated until a desired pile resistance is achieved.

Referring to FIG. 2, passageway 57 enables those portions of pile 22 below the apparatus 20 to be immediately filled with concrete. The apparatus forms anchor knobs and may then be moved up to another section of the pile 22. Concrete may flow through conduit 63 to fill up those portions of the pile below the apparatus as the apparatus is raised in this manner. The concrete so quickly applied results in a system that mitigates the risk of soil entering the pile if, for example, the anchor knobs pierced through the pile.

The structure of the housing 46, with its walls and chambers, is by way of example only. Many variations in this structure are possible to house protrusions 72 and support members 92 that are selectively moveable outwards. Also, the reservoirs 62 and 64 may be part of apparatus 20, on the top 48 thereof for example, in other embodiments.

Protrusions 72 have been shown in fluid communication with chamber 56 and rods 112 and 114 of support members in fluid communication with chamber 58. In other embodiments, the protrusions may be in fluid communication with chamber 58 and the rods may be in fluid communication with chamber 56.

Figure 10:
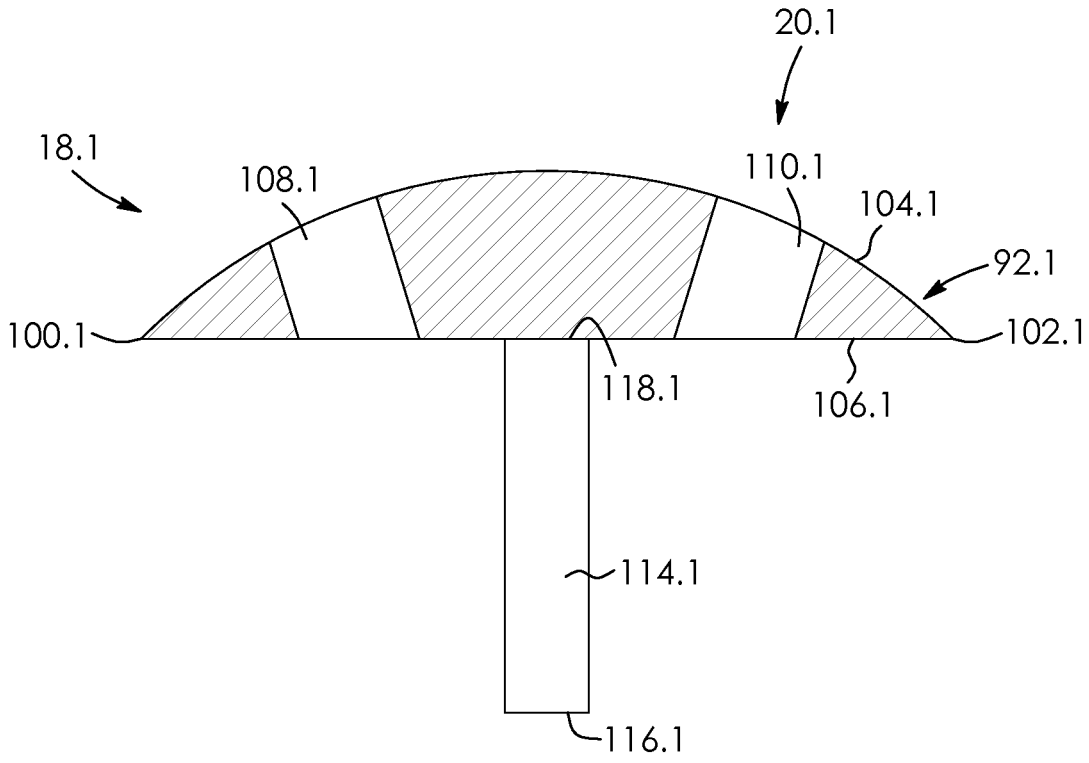
FIG. 10 is a cross-sectional view of a support member for a system and apparatus for securing a hollow pile in the ground according a second aspect.

FIG. 10 shows an example of one of a plurality of support members 92.1 according to a second aspect for a system 18.1 and apparatus 20.1 for securing pile in the ground Like parts have like numbers and functions as the support members 92 and apparatus 20 shown in FIGS. 1 to 9 with the addition of ".1". Support members 92.1 and apparatus 20.1 are substantially the same in parts and functions as support members 92 and apparatus 20 shown in FIGS. 1 to 9 with the exception that, instead of being arcuate-shaped in cross-section, each support member has an inner surface 106.1 that is straight. In this case, each support member is a circular segment in cross-section. Sides 100.1 and 102.1 are substantially edge-thin in this example. Actuators rods 114.1 abut and extend perpendicular from surfaces 106.1 of the support members 92.1. In all other manners, the rest of the apparatus 20.1 (not shown) may be substantially the same in parts and functions as apparatus 20 shown in FIGS. 1 to 9.

It will be understood by someone skilled in the art that many of the details provided above are by way of example only and are not intended to limit the scope of the invention which is to be determined with reference to at least the following claims.

What is claimed is:

1. In combination, pressurized hydraulic fluid, and an apparatus for securing a hollow pile in the ground, the pile being tubular and having a wall with an inner surface, the apparatus being positionable within the pile and comprising:

a housing receiving said pressurized hydraulic fluid, having an interior and having a plurality of circumferentially spaced-apart apertures;

a plurality of circumferentially spaced-apart protrusions slidably extending through the apertures of the housing, each of the protrusions having an arcuate-shaped stopping member, the protrusions radially extending outwards and being moveable outwards from the housing for selectively deforming portions of the wall of the pile and creating anchor knobs in the pile upon said pressurized hydraulic fluid being applied to the interior of the housing; and a plurality of circumferentially spaced-apart support members operatively connecting to and extending outwardly from the housing, the support members having outer surfaces that are arcuate-shaped and being shaped to selectively abut and support the inner surface of the wall of the pile when the anchor knobs are being formed, the support members being moveable from a retracted position in which the support members are radially inwardly spaced-apart from the inner surface of the wall of the pile to an extended position in which the support members abut the inner surface of the wall of the pile, and wherein the arcuate-shaped stopping members of the protrusions are shaped to abut the support members upon the anchor knobs being formed and are shaped to inhibit radially outwards movement of the protrusions thereafter.

2. The combination as claimed in claim 1 wherein the support members are proximal to each other so as to substantially support portions of the inner surface of the wall of the pile circumferentially extending around said protrusions.

3. The combination as claimed in claim 1 wherein the support members are located radially outwards from the housing and wherein the housing is cylindrical.

4. The combination as claimed in claim 1 wherein respective adjacent ones of the support members abut each other in the retracted position.

5. The combination as claimed in claim 1 further including a plurality of radially inwardly extending piston members, each rod connecting to a respective one of the support members, the support members slidably connecting to the housing via the piston members.

6. The combination as claimed in claim 1 wherein each of the support members has at least one aperture, wherein distal ends of the protrusions extend through said apertures of the support members, and wherein the stopping members are larger than the apertures of the support members and abut portions of the support members adjacent to the apertures of the support members upon the anchor knobs being formed.

7. The combination as claimed in claim 1 wherein the housing is shaped such that said pressurized hydraulic fluid applied to the interior of the housing causes the support members to move outwardly and abut the inner surface of the wall of the pile and causes the protrusions to selectively move outwards and radially past the support members to form said anchor knobs in the pile.

8. The combination as claimed in claim 1 further including a passageway extending through the housing, and a pile fill material, the passageway being shaped to receive said pile fill material for filling the pile with said material upon raising the housing to a different longitudinal section along the pile.

9. The combination as claimed in claim 1 wherein each of the supports members is a circular segment when viewed from above.

10. In combination, pressurized hydraulic fluid, and an apparatus for securing a hollow pile in the ground, the pile being tubular and having a wall with an inner surface, the apparatus being positionable within the pile and comprising:

a housing receiving said pressurized hydraulic fluid, having an interior, having a plurality of circumferentially spaced-apart apertures and comprising an annular outer wall, an annular inner wall that is operatively connected to and radially-inwardly spaced-apart from the outer wall, an outer chamber interposed between the inner wall of the housing and the outer wall of the housing, and an inner chamber positioned within the inner wall of the housing;

a plurality of circumferentially spaced-apart protrusions slidably extending through the apertures of the housing, the protrusions being in fluid communication with a first one of the inner chamber and the outer chamber, the protrusions radially extending outwards and being moveable outwards from the housing for selectively deforming portions of the wall of the pile and creating anchor knobs in the pile upon said pressurized hydraulic fluid being applied to the interior of the housing;

a plurality of circumferentially spaced-apart support members operatively connecting to and extending outwardly from the housing, having outer surfaces that are arcuate-shaped, and being shaped to selectively abut and support the inner surface of the wall of the pile when the anchor knobs are being formed, the support members being moveable from a retracted position in which the support members are radially inwardly spaced-apart from the inner surface of the wall of the pile to an extended position in which the support members abut the inner surface of the wall of the pile; and a plurality of piston members each of which connects to a respective one of the support members, the piston members being in fluid communication with a second one of the inner chamber and the outer chamber.

11. The combination as claimed in claim 10 wherein the inner wall of the housing has a plurality of spaced-apart apertures through which the piston members slidably extend, wherein the inner chamber receives said pressurized hydraulic fluid and wherein said pressurized hydraulic fluid applied to the inner chamber causes the support members to move radially outwards for abutting the inner surface of the wall of the pile.

12. A method of securing a hollow pile to the ground using an anchor-knob forming apparatus, the pile having a wall with an inner surface, and the apparatus having both a plurality of spaced-apart protrusions and a plurality of spaced-apart support members, the method comprising:

driving the pile into the ground;

lowering the apparatus into a portion of the pile driven into the ground;

moving the support members outwards by supplying pressurized hydraulic fluid to the apparatus; and moving the protrusions outwards and against the wall of the pile by supplying pressurized hydraulic fluid to the apparatus and thereby forming anchor knobs in the pile.

13. The method as claimed in claim 12, wherein, before forming the anchor knobs, further including the step of: filling the pile with water.

14. The method as claimed in claim 12, the apparatus having a pair of chambers, the support members hydraulically connecting to a first one of the chambers and the protrusions hydraulically connecting to a second one of the chambers, and wherein the method further includes the steps of:

supplying a pressurized hydraulic fluid to the first one of the chambers for moving the support members radially outwards; and supplying a further pressurized hydraulic fluid to the second one of the chambers for moving the protrusions radially outwards.

15. The method as claimed in claim 12, the protrusions being radially extending and circumferentially spaced-apart and the support members being circumferentially spaced-apart, and wherein the method further includes:

selectively retracting the protrusions and the support members radially inwards;

rotating the apparatus; and then further moving the support members outwards by supplying pressurized hydraulic fluid to the apparatus; and further moving the protrusions outwards and against the wall of the pile by supplying pressurized hydraulic fluid to the apparatus and thereby forming further anchor knobs in the pile.

16. The method as claimed in claim 12, the protrusions being radially extending and circumferentially spaced-apart and the support members being circumferentially spaced-apart, and wherein the method further includes:

selectively retracting the protrusions and the support members radially inwards;

moving the apparatus axially; and then further moving the support members outwards by supplying pressurized hydraulic fluid to the apparatus; and further moving the protrusions outwards and against the wall of the pile by supplying pressurized hydraulic fluid to the apparatus and thereby forming further anchor knobs in the pile.

* * * * *

UNITED STATES PATENT AND TRADEMARK OFFICE

CERTIFICATE OF CORRECTION

PATENT NO. : 9,022,695 B2
APPLICATION NO. : 13/939940
DATED : May 5, 2015
INVENTOR(S) : Michael Gregory Chin It is certified that error appears in the above-identified patent and that said Letters Patent is hereby corrected as shown below:

In the Claims

Column 9 lines 44-48 should read

5. The combination as claimed in claim 1 further including a plurality of radially inwardly extending piston members, each of the piston members connecting to a respective one of the support members, the support members slidably connecting to the housing via the piston members.

Signed and Sealed this
Twenty-fifth Day of August, 2015

Michelle K. Lee

Michelle K. Lee
*Director of the United States Patent and Trademark Office*